US005535762A

United States Patent [19]

Li

[11] Patent Number: 5,535,762

[45] Date of Patent: Jul. 16, 1996

[54] ASH TRAY ASSEMBLY

[76] Inventor: Jing-Zhi Li, 58, Ma Yuan West St., Taichung, Taiwan

[21] Appl. No.: 510,635

[22] Filed: Jul. 28, 1995

[51] Int. Cl.[6] ..... A24F 19/02; A24F 19/04; A24F 19/14

[52] U.S. Cl. ..... 131/235.1; 131/236; 131/241

[58] Field of Search ..... 131/231, 235.1, 131/236, 256, 240.1, 241, 242, 242.5, 237

[56] References Cited

U.S. PATENT DOCUMENTS 4,953,571 9/1990 Tremblay ..... 131/231
5,038,801 8/1991 Wang ..... 131/231 X

FOREIGN PATENT DOCUMENTS 0448103 9/1991 European Pat. Off. ..... 131/236
224177 11/1924 United Kingdom ..... 131/236

*Primary Examiner*—Jennifer Bahr

[57] ABSTRACT

An ash tray has a receptacle having a chamber, a protruded ring in the inner bottom of the receptacle to define a socket space, and an inner thread in the upper and inner periphery portion of the receptacle. An extension rubber bladder has inward taper holes therein. The bladder includes a board in the upper portionf which has apertures formed therein, and a block fixed in the lower portion. A cover includes an outer thread in the outer periphery portion. The cover has a cavity formed therein. A tube extends upward from the bottom portion of the cavity and an orifice formed in the upper portion thereof. The partitions are extended in the cavity. A plurality of depressions are formed on the cover. A port is in the cover for injecting water into the receptacle and a plug is provided for enclosing the port.

1 Claim, 5 Drawing Sheets

ASH TRAY ASSEMBLY

BACKGROUND OF THE INVENTION

The invention relates to an ash tray assembly. More particularly, the invention relates to an ash tray assembly which contains detachable elements to clean the dirts, soots and grimes therein.

There are many kinds of conventional ash trays. In general, most ash trays have dirts, soots and grimes which are very difficult to be cleaned after a long period of usage. Further, some ash trays contain water to distinguish the ignited cigarettes. However, water will be splashed while the ignited cigarettes is distinguished by the water.

SUMMARY OF THE INVENTION

An object of the invention is to provide an ash tray assembly which can distinguish an ignited cigarette without the splash of water.

Another object of the invention is to provide an ash tray assembly which can be detached to clean the dirts, soots and grimes therein.

An ash tray comprises a receptacle having a chamber for receiving water, a protruded ring formed in the inner bottom of the receptacle to define a socket space therein, and an inner thread formed in the upper and inner periphery portion of the receptacle. An extension rubber bladder has a plurality of inward taper holes formed therein. The rubber bladder includes a board fixed in the upper portion thereof and having a plurality of apertures formed therein, and a block fixed in the lower portion for engaging with the socket space of the protruded ring. A cover includes an outer thread formed in the outer periphery portion thereof for engaging with the inner thread of the receptacle. The cover has a cavity formed therein. A tube extends upward from the bottom portion of the cavity and includes an orifice formed in the upper portion thereof. The tube includes a hollow interior for engaging with the extension rubber bladder and an open bottom for communicating with the chamber of the receptacle. A plurality of partitions are extended in the cavity for separating the cavity into a plurality of spaces. A plurality of depressions are formed on the cover. A port is formed in the cover for injecting water into the receptacle and a plug is provided for enclosing the port.

DETAILED DESCRIPTION OF THE PREFERRED EMBODIMENT

Figure 1:
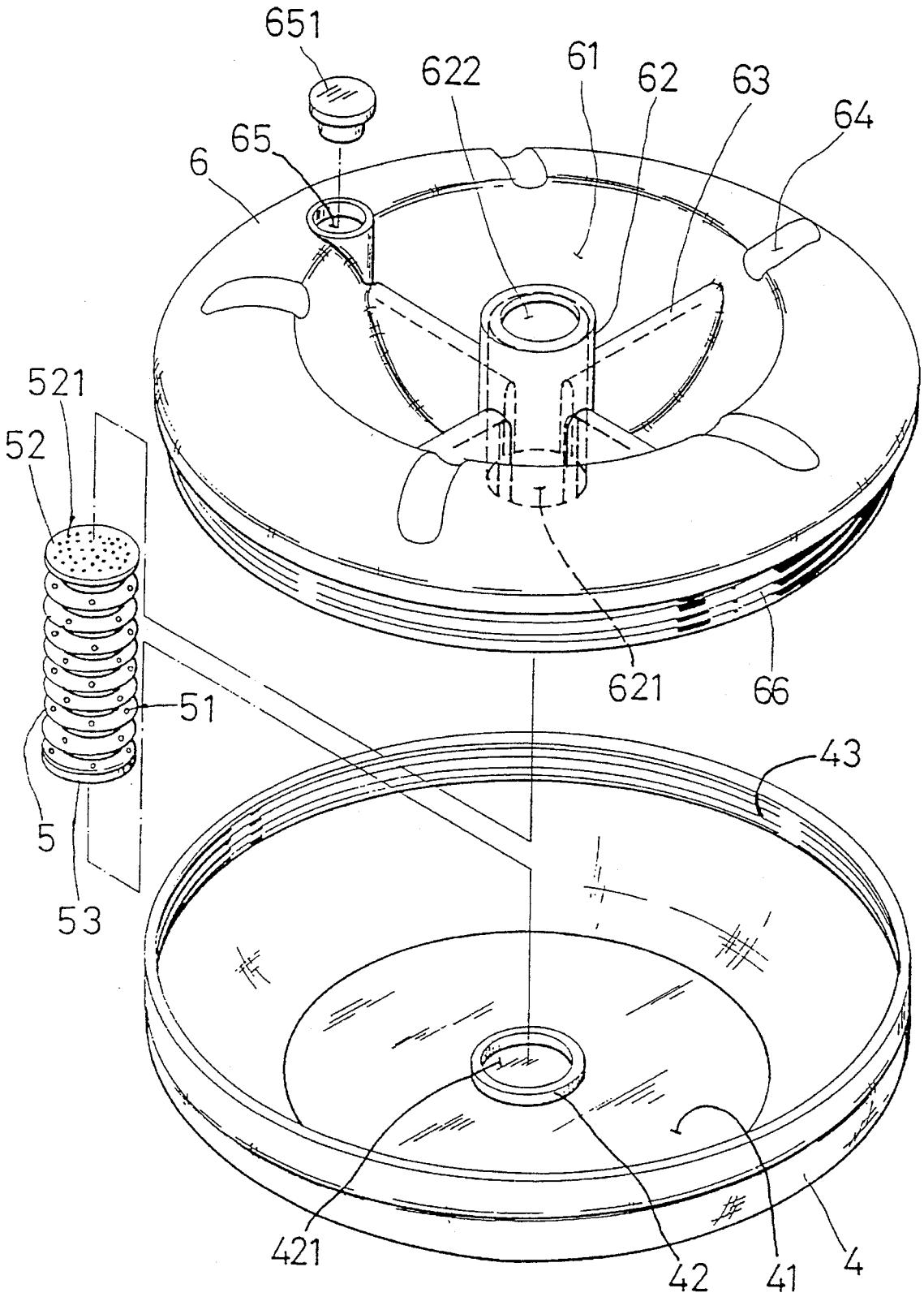
FIG. 1 is a perspective exploded view of an ash tray assembly of a preferred embodiment in accordance with the invention.
Figure 2:
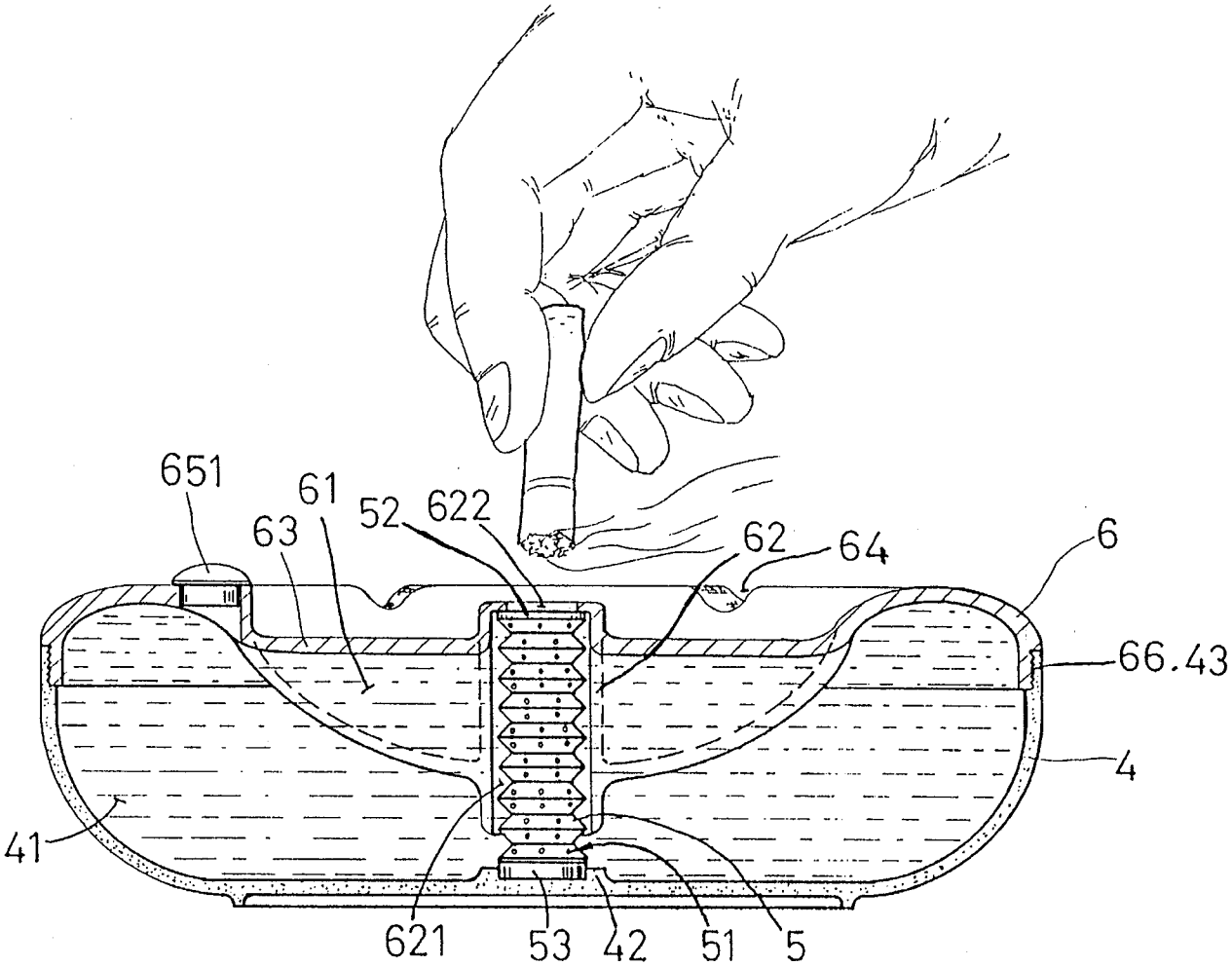
FIG. 2 is an assembly, cross-sectional view of an ash tray assembly in FIG. 1.
Figure 3:
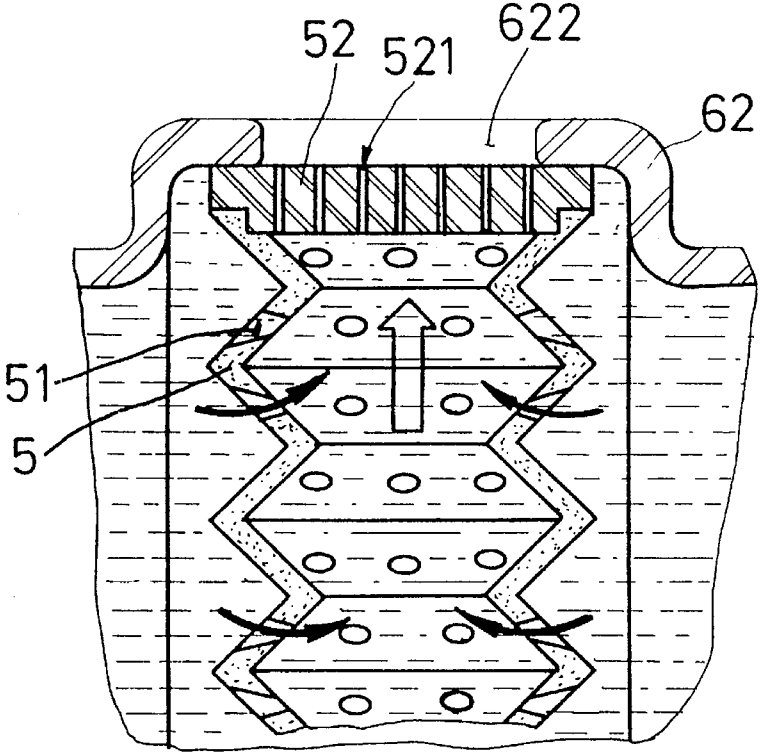
FIG. 3 illustrates a partly enlarged, cross-sectional view of FIG. 2 while the ash tray assembly is in the inoperation state.

Referring to FIGS. 1, 2 and 3, an ash tray comprises a receptacle 4 having a chamber 41 therein for receiving water, a protruded ring 42 formed in the inner bottom of the receptacle 4 to define a socket space 421 therein, and an inner thread 43 formed in the upper and inner periphery portion of the receptacle 4.

An extension rubber bladder 5 has a number of inward taper holes 51 formed therein. The rubber bladder 5 includes a board 52 fixed in the upper portion thereof and having a number of apertures 521 formed therein, and a block 53 fixed in the lower portion for engaging with the socket space 421 of the protruded ring 42.

A cover 6 includes an outer thread 66 formed in the outer periphery portion thereof for engaging with the inner thread 43 of the receptacle 4. The cover 6 has a cavity 61 formed therein. A tube 62 extends upward from the bottom portion of the cavity 61 and includes an orifice 622 formed in the upper portion thereof. The tube 62 includes a hollow interior 621 for engaging with the extension rubber bladder 5 and an open bottom for communicating with the chamber 41 of the receptacle 4. A number of partitions 63 are extended in the cavity 61 for separating the cavity 61 into a number of spaces. The cover 6 can be easily rotated with the partitions 63. A plurality of depressions 64 are formed on the cover 6 for resting a cigarette or a cigar. A port 65 is formed in the cover 6 for injecting water into the receptacle 4 and a plug 651 is provided for enclosing the port 65.

Figure 4:
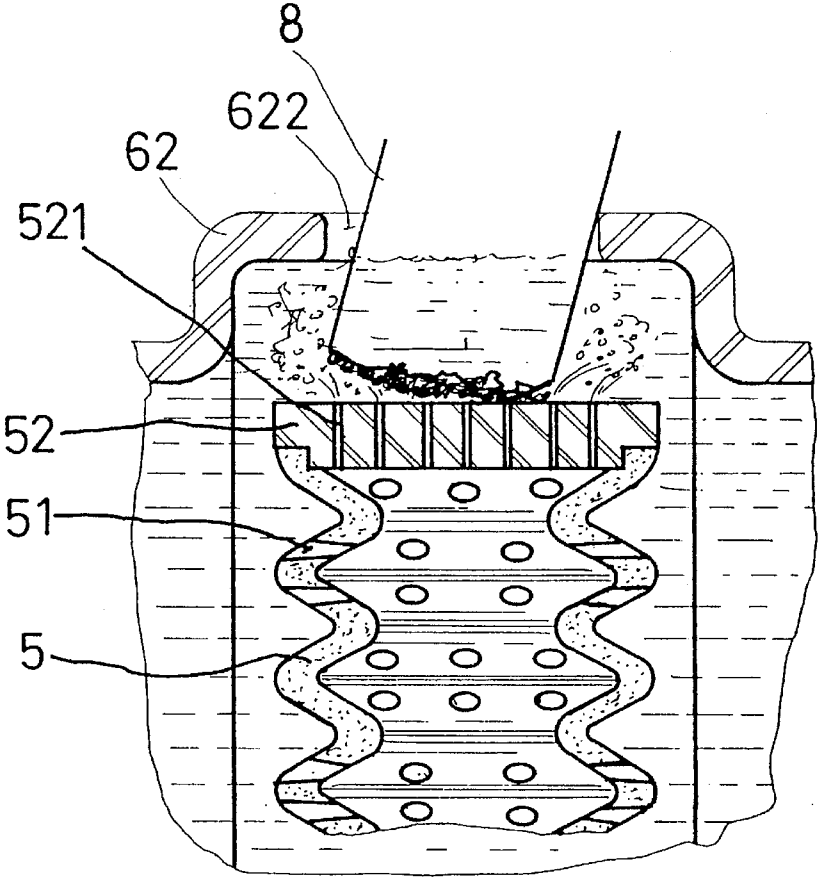
FIG. 4 illustrates a partly enlarged, cross-sectional view of FIG. 2 while the ash tray assembly is in the operation state.

In operation, as shown in FIG. 4, the ignited end 8 of the cigarette may depress the board 52 via the orifice 622 so as to depress the bladder 5 so that water may flow through the apertures 521 of the board 52 so as to distinguish the ignited end 8 of the cigarette.

Figure 5:
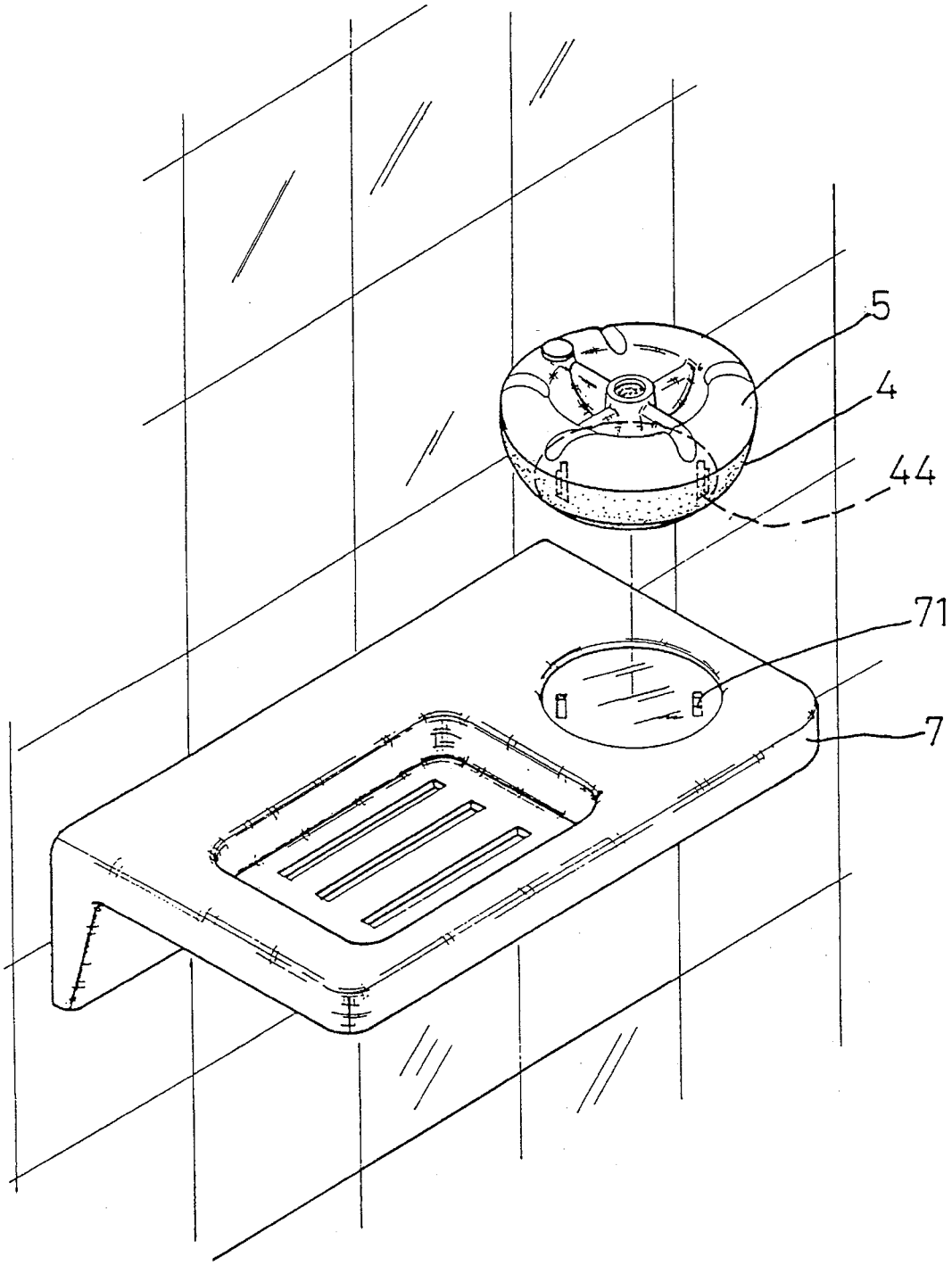
FIG. 5 is a perspective view of another preferred embodiment in accordance with the invention.
Figure 6:
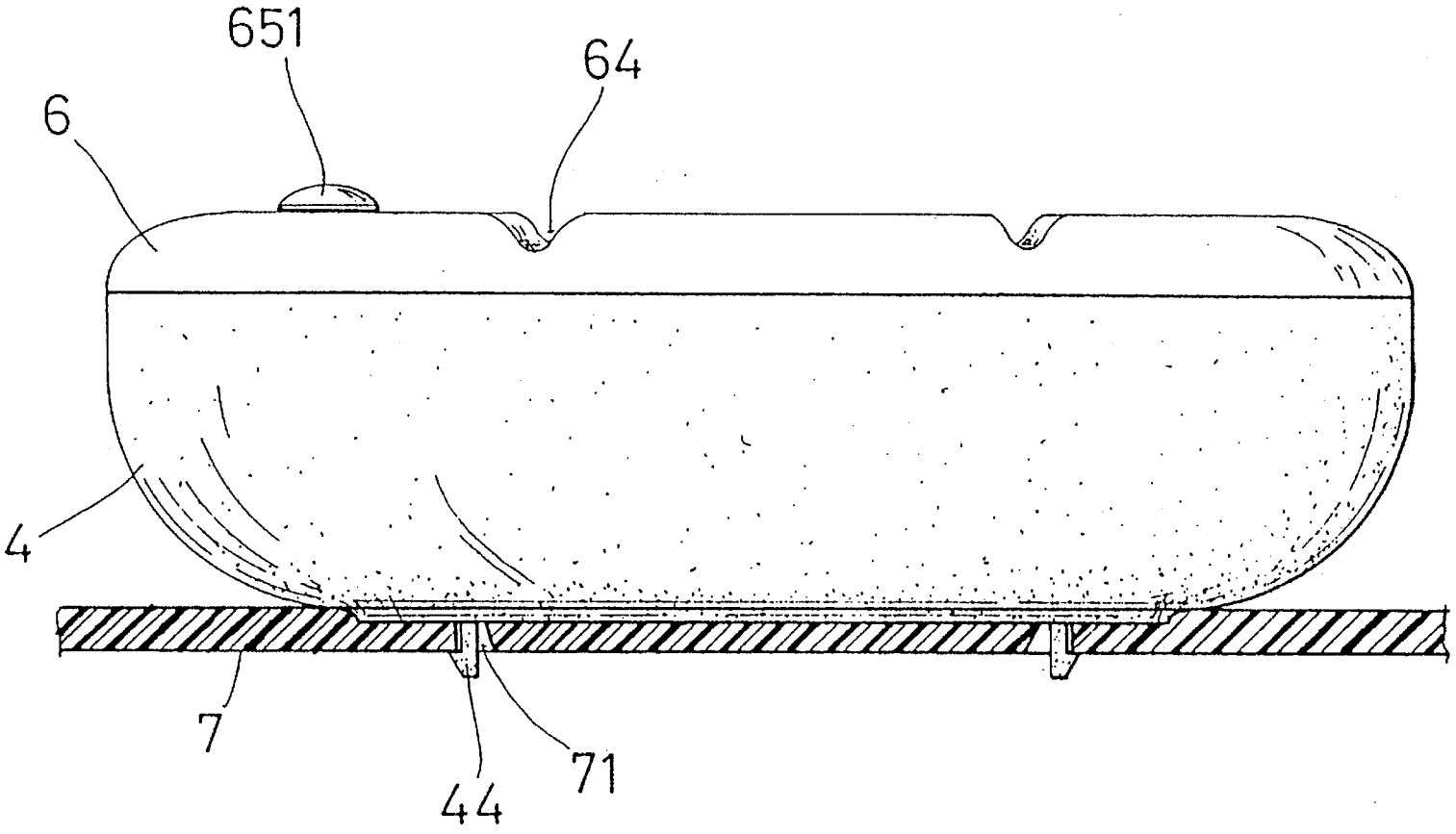
FIG. 6 is a partly cross-sectional, assembly view of an ash tray assembly of another preferred embodiments in accordance with the invention.

Referring next to FIGS. 5 and 6, the receptacle 4 may include two or more hooks 44 extended downward therefrom for engaging with openings 71 formed in suitable frame 7 so that the ash tray may be stably secured in place.

Accordingly, water may smoothly flow through the apertures 521 of the board 52, without splash, so as to distinguish the ignited end 8 of the cigarette.

The invention is not limited to the above embodiment but various modification thereof may be made. It will be understood by those skilled in the art that various changes in form and detail may be made without departing from the spirit and scope of the invention.

What is claimed is:

1. An ash tray comprising:

a receptacle having a chamber therein for receiving water;

a protruded ring formed in an inner bottom of said receptacle to define a socket space therein;

an inner thread formed in an upper and inner periphery portion of said receptacle;

an extension rubber bladder having a plurality of inward taper holes formed therein;

said rubber bladder including a board fixed in an upper portion of said rubber bladder thereof and having a plurality of apertures formed in said board;

a block fixed in a lower portion of said rubber bladder for engaging with said socket space of said protruded ring;

a cover including an outer thread formed in an outer periphery portion of said cover for engaging with said inner thread of said receptacle;

said cover having a cavity formed therein;

a tube extending upward from a bottom portion of said cavity and an orifice formed in an upper portion of said tube;

said tube including a hollow interior for engaging with said extension rubber bladder and an open bottom for communicating with said chamber;

a plurality of partitions extending in said cavity to separate said cavity into a plurality of spaces;

a plurality of depressions formed on said cover; and a port formed in said cover for injecting water into said receptacle and a plug disposed on said port for enclosing said port.

* * * * *